United States Patent [19]

Rochelle

[11] Patent Number: 4,717,147

[45] Date of Patent: Jan. 5, 1988

[54] WEIGHT LIFTING DEVICE

[76] Inventor: Richard D. Rochelle, 2337 Redwood Dr., Antioch, Calif. 94509

[21] Appl. No.: 784,610

[22] Filed: Oct. 4, 1985

[51] Int. Cl.[4] ..... A63B 21/00

[52] U.S. Cl. ..... 272/117; 272/123; 294/1.1; 294/1.5

[58] Field of Search ..... 272/67, 93, 117, 118, 272/119, 122, 123, 124, 128, 143; 404/133; 294/1.1, 1.5

[56] References Cited

U.S. PATENT DOCUMENTS

| | | | |
|---|---|---|---|
| 442,110 | 12/1890 | Donaldson | 404/133 |
| 1,510,564 | 10/1924 | Stockfleth et al. | 294/1.1 |
| 2,470,815 | 5/1949 | Harvey | 272/123 |
| 2,599,938 | 6/1952 | Price et al. | 294/15 |
| 2,841,061 | 7/1958 | Starr | 404/133 |
| 3,019,019 | 1/1962 | Forte | 272/117 |
| 4,360,198 | 11/1982 | Waulters | 272/117 |
| 4,438,920 | 3/1984 | Veillette | 272/117 X |
| 4,465,275 | 8/1984 | Lingelbach | 272/117 X |
| 4,489,935 | 12/1984 | Lusk | 272/117 |
| 4,566,690 | 1/1986 | Schook | 272/123 |
| 4,641,836 | 2/1987 | Clifton | 272/117 X |
| 4,645,203 | 2/1987 | Moss | 272/117 |
| 4,657,245 | 4/1987 | Smith | 272/117 |

FOREIGN PATENT DOCUMENTS

| | | | |
|---|---|---|---|
| 738579 | 12/1932 | France | 272/117 |

*Primary Examiner*—Richard J. Apley
*Assistant Examiner*—Robert W. Bahr
*Attorney, Agent, or Firm*—Bielen & Peterson

[57] ABSTRACT

A weight lifting device which utilizes a post having a flange fixed to one end of the post to form a base. The post and flange retain disc shaped weights commonly used in weight lifting equipment. A bar is also employed as a gripping mechanism and is rotatable in relation to the post and attached flange.

5 Claims, 3 Drawing Figures

WEIGHT LIFTING DEVICE

BACKGROUND OF THE INVENTION

The present invention relates to a novel and useful weight lifting device.

Weight lifting has been established as a excellent method of maintaining fitness and achieving muscular strength. Conventional weight lifting devices employ a horizontal bar which accepts weights on either ends of the same. The weights are generally disc shaped and are sized to various incremental weights.

Unfortunately, lifting weights can cause serious injuries to a body if not properly performed. For example, back injuries are common since the manipulation of the conventional weight lifting bar tends to bend and strain the back.

Conventional weight lifting equipment is also unwieldy and not easily transported from place to place.

The weight lifting device which overcomes some of the above noted problems of the prior art device would be a great advance in the field of sports equipment.

SUMMARY OF THE INVENTION

In accordance with the present invention a novel and useful weight lifting device is provided.

The device of the present invention utilizes a post having a flange at one end. Means is also employed for confining a conventional disc shaped weight to the post. This may easily be achieved by passing the post through the opening normally found at the center of the disc shaped weight and having the weight rest on the flange. The post may be of any length. The post and flange may also be constructed to sit in an upright position with the flange serving as a base.

A bar which is used as a grip for the hands of the user is removably attached to the post. The bar extends beyond the perimeter of the post and is rotatable in relation to the post. The post may include one or more openings through the same to allow the passage of the bar therethrough. After use of the device, the bar may be stored within the post when the post takes the form of a hollow tube.

It may be apparent that a novel and useful weight lifting device has been described.

It is therefore an object of the present invention to provide a weight lifting device which is compact and easy to use.

It is another object of the present invention to provide a weight lifting device which permits the user to lift weights without bending the user's back.

It is yet another object of the present invention to provide a weight lifting device which may be easily stored when not in use.

Another object of the present invention is to provide a weight lifting device which permits the user to perform a variety of lifts and in which the rotation of a gripping bar in relation to the post holding the weights in the device may be controlled.

The device of the present invention possesses other objects and advantages especially as concerns particular characteristics and features thereof which will become apparent as the specification continues.

For a better understanding of the invention reference is made to the following detailed description of the preferred embodiments which will be referenced to the hereinabove described drawings.

DESCRIPTION OF THE PREFERRED EMBODIMENTS

Various aspects of the present invention will evolve from the following detailed description of the preferred embodiments which should be taken in conjunction with the hereinabove described drawings.

Figure 1:
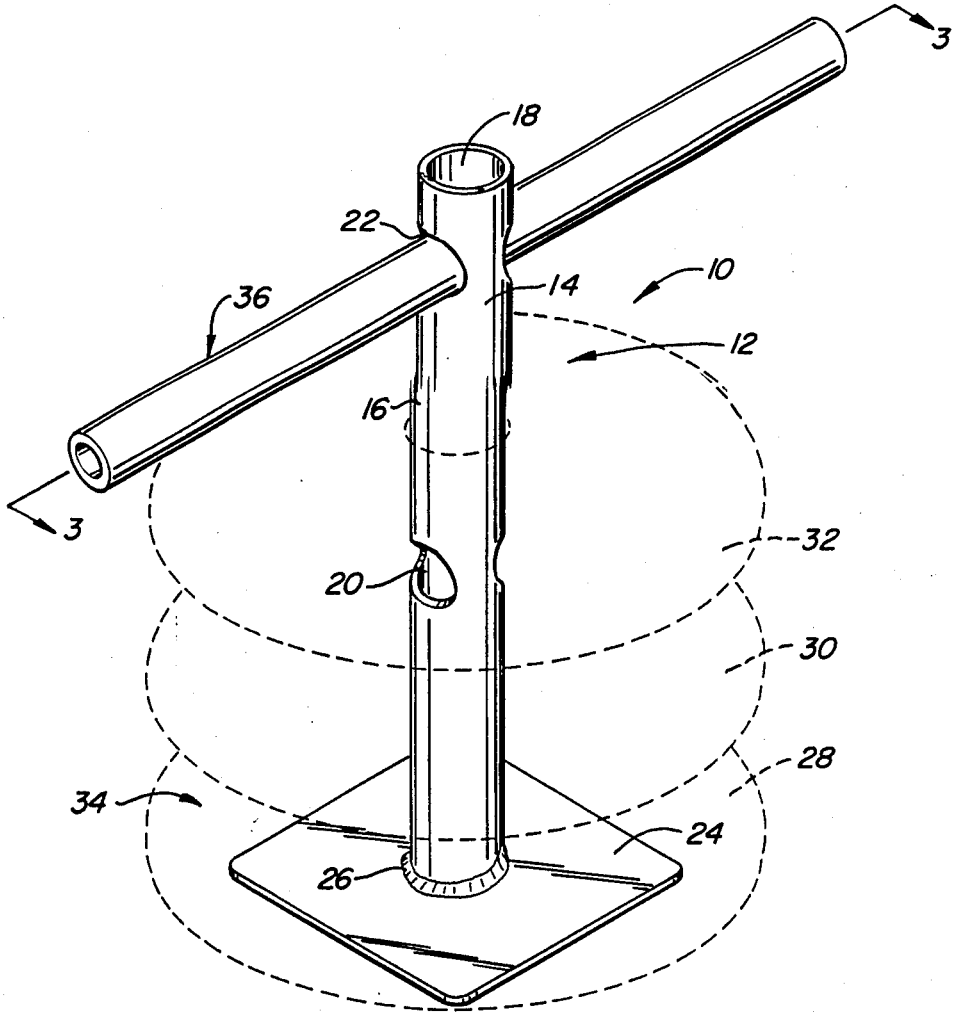
FIG. 1 is a top perspective view of the weight lifting device of the present invention showing conventional weights in phantom in place on the device.

The invention as a whole is depicted in the drawings by reference character 10. The weight lifting device 10 includes as one of its elements a post 12 which may be constructed of any rigid or semi-rigid material such as metal, wood, plastic, and the like. Post 12 is shown in FIG. 1 as a hollow tube 14 having an outer surface 16 and an inner surface 18. Post 12 also includes openings 20 and 22 which pass through post 12. A flange 24 fixed to the end of tube 14 at weld seam 26. Flange 24 is intended for contacting conventional disc shaped weights such as weights 26, 30, and 32, shown in phantom in FIG. 1. It should be noted, that post 12 and flange 24 alone may sit in an upright position on a surface. As shown in FIG. 1, weights 28, 30, and 32 aid in this disposition. Thus, means 34 is provided for confining weights 28, 30 and 32 to post 12. Means 34 in the embodiments shown in the drawings constitutes the flange 24 and the openings normally found in the conventional weights depicted in FIG. 1.

Bar 36 is also employed in the device 10. Bar 36 removably attaches to post 12 by slidingly passing through either opening 20 or 22. Bar 36 extends beyond the perimeter of the post 12 and flange 24, serving as a grip for the user of device 10, FIG. 2. Bar 36 is depicted as a hollow tube whose outside diameter is smaller than the inside diameter of 214. Thus, when bar 36 is not being used in the embodiment shown in FIG. 1, it may be stored within Post 12. Bar 36 is also rotatable in relation to post 12 and attached flange 24. Such rotation is achieved by simply sizing bar 36 to an outside diameter slightly less than the diameter of either opening 20 or 22 through post 12. Bar 36 may be constructed of material similar to that forming post 12 and flange 24.

Figure 2:
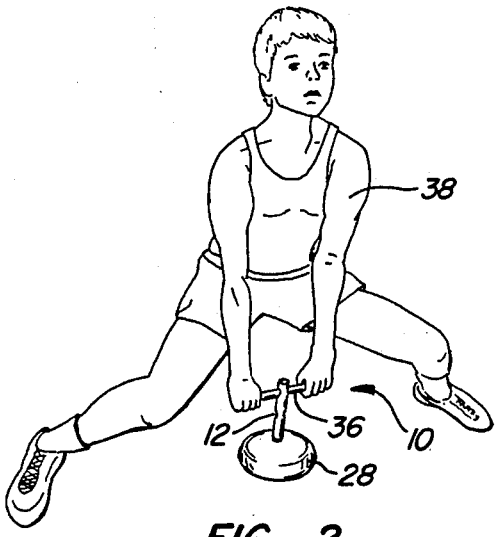
FIG. 2 is a perspective view depicting the use of the device of the present invention.
Figure 3:
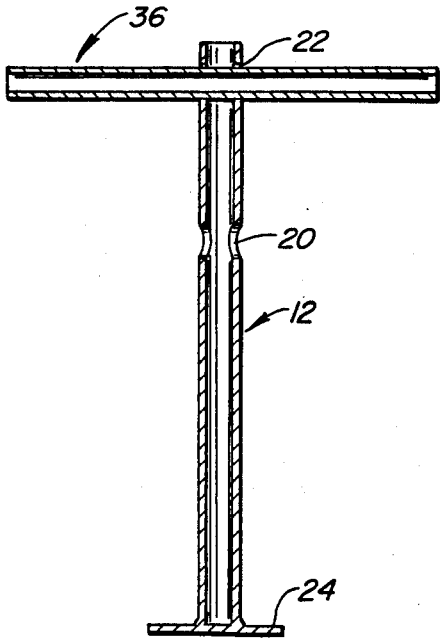
FIG. 3 is a sectional view of the device taken along line 3—3 of FIG. 1.

In operation, FIG. 2, the user may straddle device 10 having a single weight 28 placed on post 12. The device 10 is then lifted upwardly toward the chest of the user 38 without bending the user's back. It has been found that this is a relatively safe way to exercise with device 10. However, the user may lie down on his back and bring device 10 from a point above his head to a point above his midriff while maintaining his arms in an extended position. With this type of exercise, opening 20 may be used instead of opening 22 to minimize the swing of rotation of post 14 in relation to bar 36. Device 10 may be used in other ways to exercise the body using conventional weights 28, 30, and/or 32. After usage, the user 38 would place bar 36 within post 12 and store device 10 with or without the removal of weights 28, 30, and 32.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A retaining and lifting device for weights comprising:

a. a post, said post including a flange and means for confining the weight to a surrounding relationship with the post, said flange contacting the weight; and b. a bar rotatably and removably attached to the post, said bar extending beyond the perimeter of and extending substantially equal distances to opposite sides of said post, said bar serving as grips on opposite sides of said post, said post depending downwardly from said bar and being positioned in substantially orthogonal relationship with said bar, said post being rotatable in relation to said bar when said post is moved, said grips extending substantially equal distances to opposite sides of said post being usable during rotation of said bar relative to said post.

2. The device of claim 1 in which said post and flange is capable of sitting in an upright position with said flange serving as a base member.

3. The device of claim 1 in which said post includes an opening therethrough and said bar is capable of at least partially sliding through said opening in said post.

4. The device of claim 3 in which said post includes a plurality of openings therethrough and said bar is capable of at least partially sliding through said opening in said post.

5. The device of claim 3 in which said bar rotation relative to said post occurs within said opening through said post.

* * * * *